US009102992B2

(12) United States Patent
Nozaki et al.

(10) Patent No.: US 9,102,992 B2
(45) Date of Patent: Aug. 11, 2015

(54) METHOD FOR IMPROVING FATIGUE STRENGTH OF CAST IRON MATERIAL

(75) Inventors: Yoshihiko Nozaki, Higashimatsuyama (JP); Makoto Taguchi, Sakado (JP); Kazuhiro Hirakawa, Ageo (JP)

(73) Assignee: UD Trucks Corporation, Ageo-shi (JP)

( * ) Notice: Subject to any disclaimer, the term of this patent is extended or adjusted under 35 U.S.C. 154(b) by 162 days.

(21) Appl. No.: 13/990,175

(22) PCT Filed: Oct. 31, 2011

(86) PCT No.: PCT/JP2011/075033

§ 371 (c)(1), (2), (4) Date: May 29, 2013

(87) PCT Pub. No.: WO2012/073629

PCT Pub. Date: Jun. 7, 2012

(65) Prior Publication Data

US 2013/0247634 A1 Sep. 26, 2013

(30) Foreign Application Priority Data

Dec. 2, 2010 (JP) ..... 2010-268928

(51) Int. Cl.

| | |
|---|---|
| ***C21D 7/06*** | (2006.01) |
| ***B24C 1/10*** | (2006.01) |
| ***B24C 11/00*** | (2006.01) |
| ***C21D 5/00*** | (2006.01) |
| ***C23C 8/02*** | (2006.01) |
| ***C22C 33/08*** | (2006.01) |
| ***C22C 37/04*** | (2006.01) |
| ***C22C 37/10*** | (2006.01) |
| ***C21D 9/32*** | (2006.01) |
| *C21D 1/32* | (2006.01) |

(52) U.S. Cl.

CPC ... *C21D 7/06* (2013.01); *B24C 1/10* (2013.01); *B24C 11/00* (2013.01); *C21D 5/00* (2013.01); *C21D 9/32* (2013.01); *C22C 33/08* (2013.01); *C22C 37/04* (2013.01); *C22C 37/10* (2013.01); *C23C 8/02* (2013.01); *C21D 1/32* (2013.01)

(58) Field of Classification Search

CPC ..... C21D 7/06; C21D 5/00; C21D 1/32; C22C 33/08; C22C 37/04; C22C 37/10; C23C 8/02; B24C 1/00; B24C 11/00

USPC ..... 72/53, 430; 29/90.7

See application file for complete search history.

(56) References Cited

U.S. PATENT DOCUMENTS 4,961,791 A * 10/1990 Metzler et al. ..... 148/612
5,193,375 A * 3/1993 Meister ..... 72/53

(Continued)

FOREIGN PATENT DOCUMENTS

| | | |
|---|---|---|
| JP | H9-87795 | 3/1997 |
| JP | H9-217142 | 8/1997 |
| JP | H9-279229 | 10/1997 |
| JP | H11-62945 | 3/1999 |
| JP | H11-207522 | 8/1999 |
| JP | 2000-239780 | 9/2000 |
| JP | 2005-8913 A1 | 1/2005 |
| JP | 2007-307678 A1 | 11/2007 |
| JP | 2009-191342 A1 | 8/2009 |

OTHER PUBLICATIONS

International Search Report for International Application No. PCT/JP2011/075033 dated Jan. 17, 2012.

*Primary Examiner* — David B Jones

(74) *Attorney, Agent, or Firm* — Kratz, Quintos & Hanson, LLP

(57) ABSTRACT

The purpose of the present invention is to provide a method for improving fatigue strength that is capable of improving the fatigue strength of cast iron, specifically spherical graphite cast iron, to the same level as that of carbon steel subjected 10 carburizing and quenching. To this end, this method contains a step for performing first, second and third shot peenings using shot of a prescribed diameter for each on spherical graphite cast iron on which a tempering heat treatment has been performed at 150-300° C. and tensile strength made to be 800 MPa or more, the spherical graphite cast iron containing the following elements in the following mass percentages: C=2.0-4.0%, Si=1.5-4.5%, Mn=2.0% or less, P=0.08% or less, 8=0.03% or less, Mg=0.02-0.1%, and Cu=1.8-4.0%.

1 Claim, 4 Drawing Sheets

(56) References Cited

U.S. PATENT DOCUMENTS 5,352,305 A * 10/1994 Hester ..... 72/53
5,592,840 A * 1/1997 Miyasaka ..... 29/90.7
5,664,648 A * 9/1997 Hester ..... 72/53
6,722,175 B2 * 4/2004 Statnikov ..... 72/430
8,893,538 B2 * 11/2014 Miyasaka ..... 72/53

* cited by examiner

| SHOT PARTICLE SIZE (mm) | 0. 8 | 0. 9 | 1. 0 | 1. 1 |
|---|---|---|---|---|
| FATIGUE STRENGTH (MPa) | ○ | × | × | × |

| SHOT PARTICLE SIZE (mm) | 0. 3 | 0. 4 | 0. 5 |
|---|---|---|---|
| FATIGUE STRENGTH (MPa) | × | × | ○ |

| SHOT PARTICLE SIZE (mm) | 0. 3 | 0. 4 | 0. 5 |
|---|---|---|---|
| FATIGUE STRENGTH (MPa) | ○ | × | × |

FIG. 8

| SHOT PARTICLE SIZE (mm) | 0. 01 | 0. 07 | 0. 1 |
|---|---|---|---|
| FATIGUE STRENGTH (MPa) | × | × | ○ |

FIG. 9

| GEAR (Z) | EXCELLENT IN TOUCH AND SLIDING PROPERTIES BETWEEN ENGAGEMENT SURFACES |
|---|---|
| GEAR (Y) | GENERATION OF PITCHING IN ENGAGEMENT GEAR SURFACES |

FIG. 10

| TEMPERING TREATMENT TEMPERATURE (℃) | 100 | 150 | 200 | 250 | 300 | 350 |
|---|---|---|---|---|---|---|
| RESULT OF BENDING FATIGUE TEST | × | ○ | ○ | ○ | ○ | × |

FIG. 11

METHOD FOR IMPROVING FATIGUE STRENGTH OF CAST IRON MATERIAL

TECHNICAL FIELD

The present invention relates to a technology for improving a fatigue strength of a cast iron material, in particular, a spherical graphite cast iron.

BACKGROUND ART

A conventional automobile transmission gear has been manufactured by carburizing and hardening a steel material after the steel material was gear cut. However, there was a problem of deformation of a member due to heat treatment strain.

By contrast, a spherical graphite cast iron can be readily manufactured. However, it has a disadvantage that it can not be used in an automobile transmission gear because of a low fatigue strength. Accordingly, it is desired for a cast iron material which was not carburized and not hardened so as to have a fatigue strength being the same as that of a carburized and hardened steel material.

A spherical graphite cast iron has a high mechanical strength in cast irons. As a technology for improving a fatigue strength of a spherical graphite cast iron, there is an austempering treatment or quenching and tempering treatment applying to a spherical graphite cast iron containing, by weight ratio, 2.0 to 4.0% C, 1.5 to 4.5% Si, 2.0% or less Mn, 0.08% or less P, 0.03% or less S, 0.02 to 0.1% Mg, and 1.8 to 4.0% Cu.

The bending fatigue strength at $10^7$, cycles of a spherical graphite cast iron having such the composition is only about 350, MPa even with a high-tensile cast iron of 1400 MPa. This numerical value is comparable to that of a forged article, and the strength of 600 MPa or more being the same level as that of a carburized and hardened steel material is not obtained.

The fatigue strength of "about 350 MPa" can not be used in an automobile transmission gear.

As an another prior art, a technology is proposed, according to which a spherical graphite cast iron is cast to improve the fatigue strength thereof by means of adding an additive to a molten metal of a flake graphite cast iron (see Patent Document 1).

However, such the prior art intends to improve the fatigue strength by improving a casting step and can not improve the fatigue strength of a material after a cast iron material was mechanically machined.

PRIOR ART DOCUMENT

Patent Document

Patent Document 1: Japanese Patent Application Non-examined Publication No. 2005-8913

SUMMARY OF THE INVENTION

Problem that the Invention is to Solve

The present invention was proposed in view of problems of above-described prior arts, and intends to provide a method for improving a fatigue strength, which can improve the fatigue strength of a cast iron material, in particular, a spherical graphite cast iron to a value the same as that of a carbon steel that was carburized and hardened.

Means for Solving the Problems

A method for improving a fatigue strength of a cast iron material of the present invention, contains the steps of Performing a first shot peening treatment with shots having the hardness of 600 Hv or more and a particle size (ϕ) of 0.5 to 0.8 mm (1 step), performing a second shot peening treatment with shots having the hardness of 600 Hv or more and a particle size (ϕ) of 0.1 to 0.3 mm (2 step), and performing a third shot peening treatment with shots having the hardness of 600 Hv or more and a particle size (ϕ) of 0.1 mm or less (3 step)

for each on spherical graphite cast iron on which a tempering heat treatment has been performed at 150-300° C. and tensile strength made to be 800 MPa or more, the spherical graphite cast containing the following elements in the following mass percentages: C=2.0-4.0%, Si=1.5-4.5%, Mn=2.0% or less, P=0.08% or less, S=0.03% or less, Mg=0.02-0.1%, and Cu=1.8-4.0% Cu, and is applied so as to impart the.

Upon applying the present invention, it is preferable that, after performing the first to third shot peening treatments, a shot peening treatment is performed with shots composed of tin or molybdenum to perform metal lubrication.

Advantages Effects of Invention

According to the present invention having the above-described constructions, in a case that the first to third shot peening treatments are performed to a spherical graphite cast iron that contains, by weight ratio, 2.0 to 4.0% C, 1.5 to 4.5% Si, 2.0% or less Mn, 0.08% or less P, 0.03% or less S, 0.02 to 0.1% Mg, and 1.8 to 4.0% Cu and the spherical graphite cast iron has been performed tempering heat treatment at 150 to 300° C. and the tensile strength made to be 800 MPa or more, the fatigue strength of 600 MPa or more, which is the bending fatigue strength being the same level as that of carburized and hardened steel material, can be obtained.

Further, according to the present invention, a high (about 600 MPa) compressive residual stress can be imparted for a range of 100 μm from a surface by performing the first to third shot peening treatments, generations of fine cracks on a surface of a spherical graphite cast iron and development of the cracks are retarded, and therefore, an improvement of the fatigue strength.

According to the present invention, by subjecting predetermined machine process (for example, a gear-cutting process for an automobile transmission gear) to a spherical graphite cast iron, which contains, by weight ratio, 2.0 to 4.0% C, 1.5 to 4.5% Si, 2.0% or less Mn, 0.08% or less P, 0.03% or less S, 0.02 to 0.1% Mg, and 1.8 to 4.0% Cu, the tempering heat treatment has been performed thereto at 800 to 950° C. and the tensile strength made to be 800 MPa or more, and after, by performing the first to third shot peening treatments to the spherical graphite cast iron, the bending fatigue strength being the same level as that of a carburized and hardened steel material can be obtained, without performing a carburizing and hardening treatment.

Further, since it is not necessary to carry out a heat treatment (for example, a carburizing and hardening treatment) after machine processing, the heat treatment strain can be prevented.

BRIEF DESCRIPTION OF THE DRAWINGS

FIG. 8 is a drawing showing results of Experimental Example 4, as a table.

FIG. 9 is a drawing showing results of Experimental Example 5, as a table.

FIG. 10 is a drawing showing results of Experimental Example 6, as a table.

FIG. 11 is a drawing showing results of Experimental Example 7, as a table.

DESCRIPTION OF EMBODIMENTS

Hereinafter, with reference to accompanying drawings, an embodiment of the present invention will be described.

Firstly, with reference to FIG. 1, a work procedure in an illustrated embodiment will be described.

Figure 1:
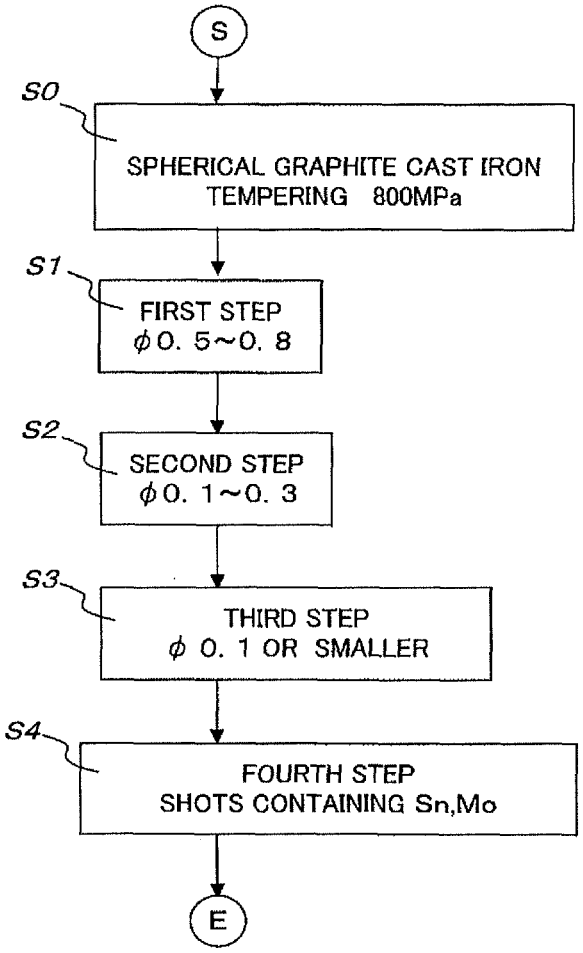
FIG. 1 is a drawing showing a procedure of a method for improving a fatigue strength of the present invention.

In FIG. 1, a spherical graphite cast iron, which contains 2.0 to 4.0% C, 1.5 to 4.5% Si, 2.0% or less Mn, 0.08% or less P, 0.03% or less S, 0.02 to 0.1% Mg, and 1.8 to 4.0% Cu, by weight ratio, is subjected to a tempering heat treatment at 150 to 300° C. so as to make the tensile strength to be 800 MPa or more (step S0).

Then, a shot peening treatment is performed with shots having hardness of 600 Hv or more and a particle size ϕ of 0.5 to 0.8 mm (step S1: a step for performing a first shot peening treatment: first step).

Next, a shot peening treatment is performed with shots having hardness of 600 Hv or more and a particle size ϕ of 0.1 to 0.3 mm (step S2: a step for performing a second shot peening treatment: second step).

Then, a shot peening treatment is performed with shots having hardness of 600 Hv or more and a particle size ϕ of 0.1 mm or less (step S3: a step for performing a third shot peening treatment: third step).

Thereafter, with tin or molybdenum shots having an appropriate hardness and particle size, a shot peening treatment is performed (step S4: a step for performing a fourth shot peening treatment: fourth step).

According to the step S4, on a surface of a workpiece on which the first to third shot peening treatments were performed, metal lubrication can be performed.

In addition, the step S4 may be omitted.

Figure 3:
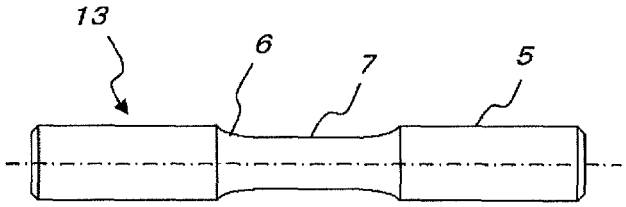
FIG. 3 is a drawing showing a piece for a bending fatigue test.

From a test sample being performed the first to third shot peening treatments (1 to 3 steps) thereon, a fatigue test sample shown in FIG. 3 was manufactured.

In an embodiment shown in the drawing, a shape of a bending fatigue test piece being entirety shown by a numeral 13 has a radius reduced small diameter portion 7 at a center portion of a round bar portion 5 having an outer diameter of 12 mm. Both ends of the small diameter portion 7 are smoothly connected to the round bar portion 5 with an arc-like R curve 6.

With such the test piece 13, a rotating bending fatigue test was performed.

As will be described in Experimental Example 1 described below, the fatigue strength of a spherical graphite cast iron to which the shot peening treatments of steps S1 to S3 of FIG. 1 were performed has the bending fatigue strength (for example, about 600 MPa) the same as that of a carburized and hardened steel material.

The inventors have carried out experiments (Experimental Example 1 to Experimental Example 7) such as shown below with a spherical graphite cast iron, which contains 2.0 to 4.0% C, 1.5 to 4.5% Si, 2.0% or less Mn, 0.08% or less P, 0.03% or less S, 0.02 to 0.1% Mg, and 1.8 to 4.0% Cu, by weight ratio.

EXPERIMENTAL EXAMPLE 1

By performing the tempering heat treatment to the above-mentioned spherical graphite cast iron at 150 to 300° C., the tensile strength is made to be 800 MPa or more.

Figure 2:
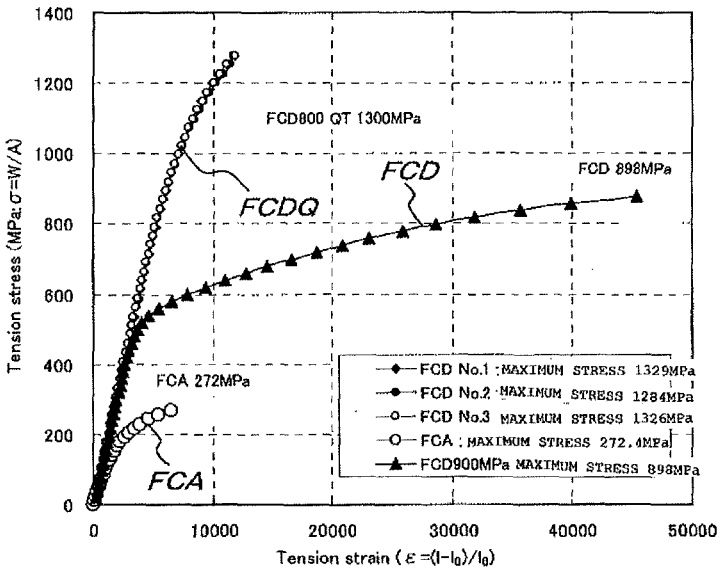
FIG. 2 is a drawing showing test results of a tensile test of test samples.

Results of a tensile test of a test sample, in which samples the tempering heat treatment applies to the spherical graphite cast iron (the spherical graphite cast iron to which the tempering heat treatment has been applied), are shown with a characteristic curve FCD in FIG. 2.

In FIG. 2, a vertical axis shows a tensile stress (MPa) and a horizontal axis shows a tensile strain (ϵ). The maximum tensile stress is 898 MPa in the characteristic curve FCD.

The characteristic curve FCDQ shown in FIG. 2 has the maximum tensile stress of 1300 MPa after heat treating the spherical graphite cast iron. The characteristic curve FCA shows characteristics of gray iron (gray cast iron) and shows the maximum tensile strength of 272 MPa.

Next, with shots having hardness of 600 Hv or more and a particle size (ϕ) of 0.5 to 0.8 mm, a first shot peening treatment was performed. Then, a second shot peening treatment was performed on the test piece with shots of 600 Hv or more and a particle size (ϕ) of 0.1 to 0.3 mm. Further, a third shot peening treatment was performed on the test piece, on which the first and second shot peening treatments were performed, with shots of 600 Hv or more and a particle size (ϕ) of 0.1 mm or less.

Figure 4:
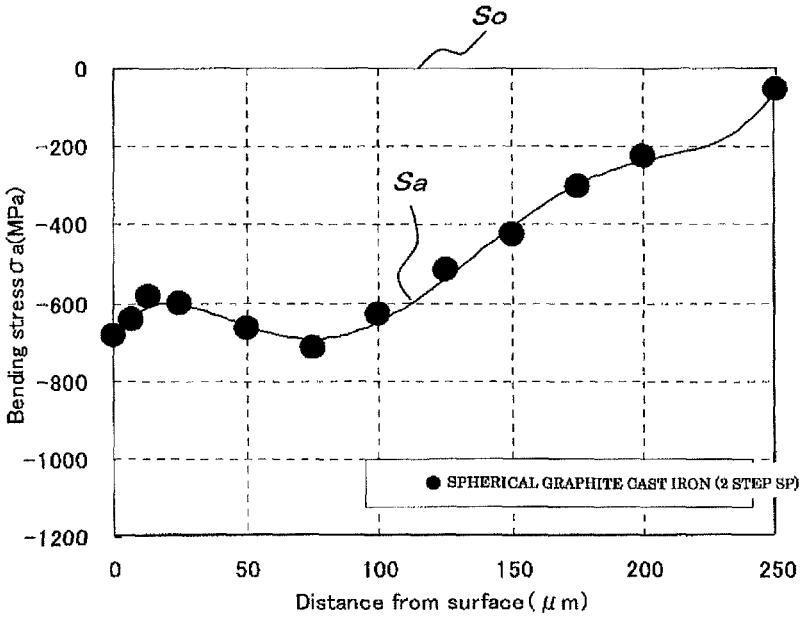
FIG. 4 is a drawing showing a distribution of compressive residual stresses after the first to third shot peening treatments were performed.

Measurement results of a residual stress of a test piece, to which the first to third shot peening treatments were performed, are shown in a curve Sa showing a residual stress distribution of FIG. 4.

In FIG. 4, within a range of a depth of 100 μm from a surface (0 μm) of the test piece, a slight variation of the residual stress is found. However, a residual compressive stress is generally −600 (MPa).

In FIG. 4, a vertical axis shows a numerical value of the tensile stress. Therefore, in FIG. 4, in a case that a numerical value of the compressive residual stress is high, it is shown in a lower part (on a side where a negative absolute value is large).

With reference to FIG. 4, it is found that a compressive residual stress is present in a region of a depth 200 μm from a surface in a test piece to which the first to third shot peening treatments were performed, and such the compressive residual stress is not found in a test piece to which the first to third shot peening treatments were not performed (in FIG. 4, a vertical axis is zero MPa, and a horizontal axis is a line S0 being in parallel with a horizontal coordinate).

In Experimental Example 1, the first to third shot peening treatments were performed on the same test piece, from the material, a fatigue test piece shown in FIG. 3 was manufactured, and the rotating bending fatigue test was performed thereon. Results of such the fatigue test are shown in FIG. 5.

Figures 5, 6, 7:
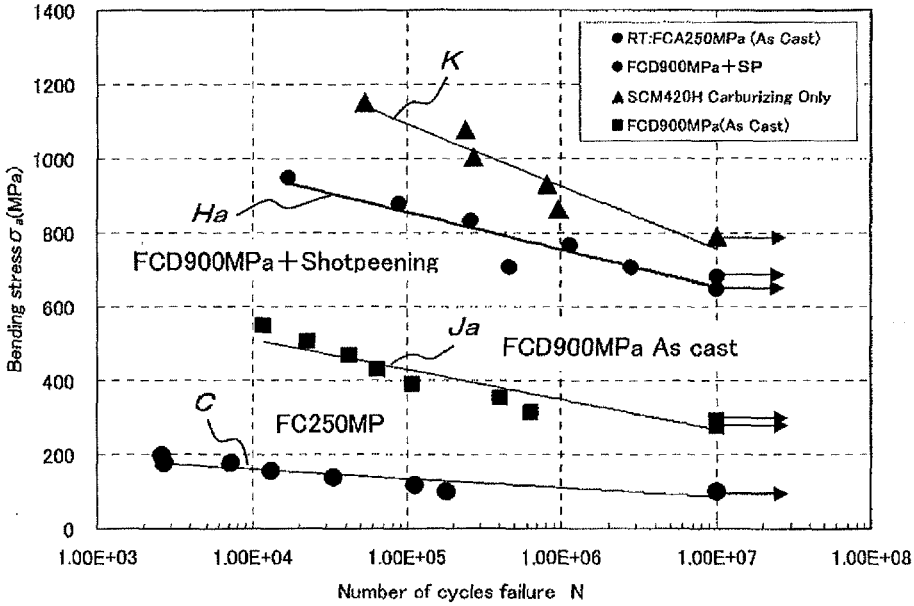
FIG. 5 is a drawing showing test results of rotating bending fatigue tests in Experimental Example 1.
FIG. 6 is a drawing showing results of Experimental Example 2, as a table.
FIG. 7 is a drawing showing results of Experimental Example 3, as a table.

In FIG. 5, a vertical axis shows a bending stress (σ), and a horizontal axis shows the number of times of repetition (N).

A mark H in FIG. 5 shows a characteristics curve showing the bending fatigue strength of a test piece to which the first to third shot peening treatments were performed in Experimental Example 1 and the fatigue strength was 620 to 630 MPa.

The fatigue strength of 620 to 630 MPa shown in Experimental Example 1 is a numerical value which is close to the fatigue strength of 700 MPa of a carburized and hardened steel SCM 420H shown with a mark K in FIG. 5.

That is, according to Experimental Example 1 the fatigue strength, which is being the same level as that of the carburized and hardened steel SCM 420H, is obtained.

In FIG. 5, a bending fatigue curve J shows a bending fatigue strength of a high tensile cast iron FCD 900 MPa to which a shot peening treatment was not performed, the fatigue curve strength thereof was 300 MPa.

A bending fatigue curve C shows a bending fatigue strength of a cast iron in a forged state, and a fatigue strength thereof was 100 MPa. In addition, the characteristics in a tensile test of a cast iron are shown by a characteristic curve FCA in FIG. 2.

In Experimental Example 1 from results shown in FIG. 5, it was found that the bending fatigue strength being generally the same level as that (about 600 MPa) of a carburized and hardened low carbon steel material can be obtained, by performing tempering heat treatment at 150 to 300° C. to the spherical graphite cast iron, which contains 2.0 to 4.0% C, 1.5 to 4.5% Si, 2.0% or less Mn, 0.08% or less P, 0.03% or less S, 0.02 to 0.1% Mg, and 1.8 to 4.0% Cu, by weight ratio, made the tensile strength to be 800 MPa or more, and then, performing the first to third shot peening treatments thereto.

EXPERIMENTAL EXAMPLE 2

When a first shot peening treatment is performed with respect to a test piece used in Experimental Example 1 (the spherical graphite cast iron, which contains 2.0 to 4.0% C, 1.5 to 4.5% Si, 2.0% or less Mn, 0.08% or less P, 0.03% or less S, 0.02 to 0.1% Mg, and 1.8 to 4.0% Cu, by weight ratio, a tempering heat treatment performed thereto at 150 to 300° C. and is made the tensile strength to be 850 MPa or more), a fatigue test of bending fatigue strength was performed to test pieces, which is manufactured in a manner the same as that of Experimental Example 1 except that shots having a particle size larger than 0.8 mm (particle size: 0.9 mm, 1.0 mm, and 1.1 mm) were used.

In FIG. 6, results of the fatigue test (results of Experimental Example 2) when a first shot peening treatment was performed with shots having a particle size of 0.8 mm, 0.9 mm, 1.0 mm or 1.1 mm are shown. In FIG. 6, "○" shows that the fatigue strength being the same level as 600 MPa was obtained, and "×" shows that the fatigue strength did not reach about 600 MPa.

Although in a case that a shot particle size is 0.8 mm, the fatigue strength the same as that (about 600 MPa) of a carburized and hardened steel material was obtained ("○" in FIG. 6), in an other case that a shot particle size is 0.9 mm, 1.0 mm or 1.1 mm, the bending fatigue strength was 600 MPa or less ("×" in FIG. 6).

From FIG. 6, it was found that in the first shot peening treatment, a shot particle size should be set to 0.8 mm or less.

When the shot particle size is larger than 0.8 mm in the first shot peening treatment, it is considered that shots are not conveyed by an air flow when shots are blasted off, and therefore, sufficient impact can not be imparted to the test piece.

EXPERIMENTAL EXAMPLE 3

In a manner being similar to that of Experimental Example 1,, except that in a first shot peening treatment, shots of 0.5 mm or smaller (particle size: 0.5 mm, 0.4 mm, 0.3 mm) were used, the fatigue test was performed of the bending fatigue strength.

Also in FIG. 7, "○" shows that the fatigue strength being the same level as about 600 MPa was obtained, and "×" shows that the fatigue strength did not reach about 600 MPa.

As shown in FIG. 7, in a case that a shot particle size is 0.5 mm, the fatigue strength being the same level as that (about 600 MPa) of a carburized and hardened steel material could be obtained ("○" of FIG. 7). However, in an another case that a shot particle size is 0.4 mm or 0.3 mm, the bending fatigue strength was 600 MPa or smaller ("×" of FIG. 7).

From the drawing of FIG. 7, it was found that in the first shot peening treatment, a shot particle size should be set to 0.5 mm or larger.

It is considered in a case that a shot particle size is smaller than 0.5 mm in the first shot peening treatment, although the compressive stress on a surface side of a steel material becomes higher, the compressive stress inside the steel material becomes smaller.

EXPERIMENTAL EXAMPLE 4

In a manner similar to that of Experimental Example 1, except that in a second shot peening treatment, shots of 0.3 mm or larger (particle size: 0.3 mm, 0.4 mm, 0.5 mm) were used, the fatigue test was performed of the bending fatigue strength.

In FIG. 8, "○" shows that the fatigue strength being the same level as about 600 MPa was obtained, and "×" shows that the fatigue strength did not reach about 600 MPa.

As shown in FIG. 8, in a case that a shot particle size is 0.3 mm, the fatigue strength being the same level as that (about 600 MPa) of a carburized and hardened steel material could be obtained ("○" of FIG. 8). However, in an another case that a particle size is 0.4 mm or 0.5 mm, the bending fatigue strength was 600 MPa or smaller ("×" of FIG. 8).

From results of Experimental Example 4 (FIG. 8), it was found that in the second shot peening treatment, a shot particle size should be set to 0.3 mm or smaller.

Although the second shot peening treatment is a treatment that improves the compressive residual stress of the outermost surface (a region where a distance from a surface is 50 μm) of a cast iron test piece, it is assumed that a peak of the compressive residual stress is not generated on the most surface and the fatigue strength was not improved, in a case that a shot particle size is larger than 0.3 mm.

EXPERIMENTAL EXAMPLE 5

In a manner similar to that of Experimental Example 1, except that in a second shot peening treatment, shots of 0.1 mm or smaller (particle size: 0.1 mm, 0.07 mm, 0.01 mm) were used, the fatigue test was performed of the bending fatigue strength.

In FIG. 9, "○" shows that the fatigue strength of about 600 MPa could be obtained, and "×" shows that the fatigue strength did not reach about 600 MPa.

As shown in FIG. 9, in a case that a shot particle size is 0.1 mm, the fatigue strength being the same level as that (about 600 MPa) of a carburized and hardened steel material could be obtained ("○" of FIG. 9). However, in an another case that a particle size is 0.07 mm or 0.01 mm, the bending fatigue strength was 600 MPa or smaller ("×" of FIG. 9).

From results of Experimental Example 5 (FIG. 9), it was found that in the second shot peening treatment, a shot particle size should be set to 0.1 mm or larger.

It is assumed that when a particle size of shots used in the second shot peening treatment is small, only a surface of a cast iron is smoothened, the compressive residual stress of the outermost surface of a steel material was not generated, and the fatigue strength could not be improved.

EXPERIMENTAL EXAMPLE 6

Gears (gears on which the first to third shot peening treatments were performed) Z being manufactured with a test material of Experimental Example 1 and gears Y being manufactured with a test material, to which the third shot peening treatment was not applied, were prepared. And then, as shown in FIG. 10, sliding properties of engagement surfaces thereof were compared.

As to gears (gears on which the first to third shot peening treatments were performed) Z being manufactured with a test material of Experimental Example 1 the sliding properties of an engagement surface were good.

By contrast, as to gears Y being manufactured with a test material to which the third shot peening treatment was not applied, the sliding properties of an engagement surface showed abnormality.

In more detail, in FIG. 10, the gears Z were good in touch and sliding properties between engagement gear surfaces and cleared the predetermined endurance test. By contrast, the gears Y were not good in touch and sliding properties between engagement gear surfaces, generated fine cracks on a gear surface, and could not clear the predetermined endurance test.

From results of Experimental Example 6 (FIG. 10), it was found that the third shot peening treatment should not be omitted.

According to the third shot peening treatment, a surface that was roughened by the first and second shot peening treatments is smoothened, and an irregularity of a gear surface becomes smaller; accordingly, in the case of fine irregularity, an oil stays therein to exert a lubrication operation.

It is assumed that since the test material, to which the third shot peening was not applied, could not exert such the lubrication operation, sliding abnormality was generated on an engagement surface.

EXPERIMENTAL EXAMPLE 7

The test piece used in the Experimental Example 1 (spherical graphite cast iron being performed tempering heat treatment, the spherical graphite cast iron containing 2.0 to 4.0% C, 1.5 to 4.5% Si, 2.0% or less Mn, 0.08% or less P, 0.03% or less S, 0.02 to 0.1% Mg, 1.8 ~4.0% Cu in mass percentage) was performed tempering heat treatment at 100 to 350° C. The temperature changed by 50° C. each time to make six kinds of the test pieces. Other treatments to each sample were the same as the Experimental Example 1. Fatigue tests of bending fatigue strength were conducted for each of the six test pieces. FIG. 11 shows the results of the Experimental Example 7.

The code "○" shown in FIG. 11 shows that it was possible to obtain the bending fatigue strength being the same level as that (600 MPa) of low carbon steel which underwent carburizing and quenching.

Meanwhile, the code "×" shows that it was not possible to obtain the bending fatigue strength at the same level as that (close to 600 MPa) of the bending fatigue strength of low carbon steel which underwent carburizing and quenching. From the results of Experimental Example 7 (FIG. 11), one could confirm that the bending fatigue strength at the same level as that (600 MPa) of low carbon steel which underwent carburizing and quenching was obtained in the tempering heat treatment temperature range from 150 to 300° C.

Illustrated embodiments are merely examples and do not intend to limit a technical range of the present invention.

For example, illustrated embodiments can be applied to a cum of a valve operating system, con rod, gear and various kinds of pumps for supplying high pressure oil.

Explanation of Reference Numerals

5 ROUND BAR PORTION
6 R CURVE
7 SMALL RADIUS PORTION
13 BENDING TEST PIECE
Y GEAR PREPARED WITH MATERIAL OBTAINED BY OMITTING THIRD STEP
Z GEAR PREPARED WITH MATERIAL AFTER EXPERIMENT 1

The invention claimed is:

1. A method for improving a fatigue strength of a spherical graphite cast iron, the spherical graphite cast iron having a cast iron material which contains 2.0 to 4.0% C, 1.5 to 4.5% Si, at most 2.0% or Mn, at most 0.08% P, at most 0.03% S, 0.02 to 0.1% Mg, and 1.8 to 4.0% Cu, by weight ratio, and has applied thereto tempering heat treatment so as to be made with a tensile strength of at least 800 MPa, the method comprising the steps of:

performing a first shot peening treatment with shots having the hardness of at least 600 Hv and a particle size (ϕ) of 0.5 to 0.8 mm;

performing a second shot peening treatment with shots having the hardness of at least 600 Hv and a particle size (ϕ) of 0.1 to 0.3 mm; and performing a third shot peening treatment with shots having the hardness of at least 600 Hv and a particle size (ϕ) of at most 0.1 mm.

* * * * *